US006031322A

United States Patent [19]

Takemura et al.

[11] Patent Number: 6,031,322

[45] Date of Patent: Feb. 29, 2000

[54] FIELD EMISSION COLD CATHODE HAVING A SERIAL RESISTANCE LAYER DIVIDED INTO A PLURALITY OF SECTIONS

[75] Inventors: Hisashi Takemura; Masayuki Yoshiki, both of Tokyo, Japan

[73] Assignee: NEC Corporation, Tokyo, Japan

[21] Appl. No.: 08/878,766

[22] Filed: Jun. 19, 1997

[30] Foreign Application Priority Data

Jun. 21, 1996 [JP] Japan ..... 8-162131

[51] Int. Cl.[7] ..... H01J 1/30

[52] U.S. Cl. ..... 313/309; 313/336; 313/351; 445/24; 445/25; 257/10

[58] Field of Search ..... 313/309, 336, 313/351, 495, 496, 497, 308, 306; 257/10, 11; 445/24, 25, 27

[56] References Cited

U.S. PATENT DOCUMENTS

| | | | |
|---|---|---|---|
| 5,475,280 | 12/1995 | Jones et al. | 313/309 |
| 5,557,160 | 9/1996 | Makishima et al. | 313/309 |
| 5,572,041 | 11/1996 | Betsui et al. | 313/309 |
| 5,587,623 | 12/1996 | Jones | 313/309 |

FOREIGN PATENT DOCUMENTS

| | | |
|---|---|---|
| 2713394 | 6/1995 | France . |
| 62-213435 | 9/1987 | Japan . |
| 2-500065 | 1/1990 | Japan . |
| 2-220526 | 9/1990 | Japan . |
| 5-036345 | 2/1993 | Japan . |
| 5-36345 | 2/1993 | Japan . |
| 6-096663 | 4/1994 | Japan . |
| 6-96663 | 4/1994 | Japan . |
| 6-204980 | 7/1994 | Japan . |
| 7-94076 | 4/1995 | Japan . |
| 7-141984 | 6/1995 | Japan . |
| 7-182966 | 7/1995 | Japan . |
| 7201272 | 8/1995 | Japan . |
| 8-106846 | 4/1996 | Japan . |
| 9204732 | 3/1992 | WIPO . |
| 9318536 | 9/1993 | WIPO . |
| 9420975 | 9/1994 | WIPO . |

*Primary Examiner*—Nimeshkumar D. Patel
*Assistant Examiner*—Joseph Williams
*Attorney, Agent, or Firm*—Sughrue, Mion, Zinn, Macpeak & Seas, PLLC

[57] ABSTRACT

A field emission cold cathode has a plurality of emitters in a group for each gate electrode and a serial resistance layer divided into a plurality resistance layer sections each corresponding to one of the emitters. The resistance layer is divided by a deep trench filled with an insulator layer or conductive layer forming a P-N junction between the same and the resistance layer section. A linear voltage-current characteristic is obtained by a stable resistance of the resistance layer section to prevent a short-circuit failure between the emitter and the gate electrode.

6 Claims, 13 Drawing Sheets

FIELD EMISSION COLD CATHODE HAVING A SERIAL RESISTANCE LAYER DIVIDED INTO A PLURALITY OF SECTIONS

BACKGROUND OF THE INVENTION (a) Field of the Invention

The present invention relates to a field emission cold cathode and a method for manufacturing the same and, more particularly, to the structure of a resistance layer serially connected with the emitter in a field emission cold cathode.

(b) Description of the Related Art

In general, a field emission cold cathode comprises a conical emitter having a pointed tip and a gate electrode having a submicron-order opening for providing a high electric field around the tip of the conical emitter for emitting electrons from the tip in the vacuum.

In the conventional field emission cold cathode, the distance between the emitter and gate electrode is small so that there sometimes occur a short-circuit failure between the emitter and gate electrode caused by a meltdown of the emitter due to a large current flowing through the emitter and triggered by the gaseous ambient of the emission. To prevent such a breakdown failure, it is proposed to provide a serial resistance layer to the emitter so as to limit the emitter current for prevention of the emitter meltdown.

Among the proposals to provide the resistance layer, a first conventional example is described in JP-A-5(1993)-36345, wherein the serial resistance layer is epitaxially grown for a silicon emitter. FIGS. 1A to 1F consecutively show a fabrication process for the first conventional example in sectional views thereof. In the fabrication process, a resistance layer 42 is formed by an epitaxial process as a lightly doped epitaxial layer on an N-type silicon substrate 41 which is connected to a cathode electrode. Subsequently, a heavily doped epitaxial layer 43 is formed thereon, followed by forming an oxide layer 44 on the epitaxial layer 43. Then, the oxide layer is patterned to form a mask pattern 44, followed by an isotropic dry etching of the heavily doped layer 43 and the resistance layer 42 by using the mask pattern 44 to form a protrusion from the heavily doped layer 43, as shown in FIG. 1B. Thereafter, a thermal oxidation step is effected to form a thermal oxide layer 45 and to sharpen the tip of the protrusion including the resistance layer 43 and heavily doped layer 42, as shown in FIG. 1C.

Next, electron beam evaporation step is effected to consecutively deposit an insulator film 46 and a gate electrode layer 47 from above to the entire surface of the wafer in the vertical direction, as shown in FIG. 1D. Then, an etching step is effected by using a hydrofluoric acid to remove the mask pattern 44 and insulator film 46, thereby selectively removing the gate electrode film 47 by a lift-off method in the vicinity of the emitter, i.e., emitter area. The etching step also removes the exposed oxide film 45 on the emitter to expose the conical emitter 48 including the heavily doped layer 43 and underlying serial resistance layer 42, as shown in FIG. 1E. A subsequent patterning step for the gate electrode layer 47 provides the structure as shown in FIG. 1F. The serial resistance layer 42 is associated with the heavily doped layer 43 to function as a protective layer for prevention of the emitter meltdown by alleviating the electric field around the tip of the conical emitter 48.

Among the proposals to provide the resistance layer, a second conventional example is described in JP-A-7(1995)-94076, wherein an emitter formed as a vacuum-deposited metal layer is provided with a patterned resistance layer.

FIG. 2 shows the second conventional example which comprises an insulating substrate 51, a cathode layer 52 selectively formed on the substrate 51 to form a plurality of conductor pieces each connected to a cathode electrode not shown, a resistance layer 53 divided into a plurality of resistance sections each connected to the conductor pieces of the cathode layer 52, an insulator layer 54 overlying the resistance layer 53 and having a plurality of holes therein, a gate electrode layer 55 formed on the insulator layer 54 and having an opening corresponding to each hole, and a conical emitter 58 made of a metallic film and formed on the resistance layer 53 in the corresponding one of the holes in the insulator layer 54. The edge of the resistance layer section 53 is of a comb-shape having teeth connected to corresponding conductor piece of the cathode layer 52. Each resistance layer section 53 mounts thereon a group of emitters 58 (or emitter block) for protection.

In the second conventional example, if the emitter 58 and gate electrode layer 55 are short-circuited, the corresponding resistance layer 53 mounting the emitter 58 is fused at the edge portion thereof, i.e., at the teeth of the comb, to be disconnected from the corresponding cathode layer 52, thereby disabling the emitter block mounted on the resistance layer section 53 and including the short-circuited emitter 58. Although the emitter block itself does not operate thereafter, other emitter blocks can operate as usual to substantially maintain the function of the field emission cold cathode as a whole.

In the second conventional example, the comb-shape resistance layer section 53 connected to the cathode conductor layer 52 should have long and thin teeth in order to effectively break the connection between the resistance layer section 53 and the cathode layer 52 by fusing the teeth. That is, the resistance layer section 53 should have a sufficient space between two adjacent emitter blocks for the teeth. In order to decrease the occupied area for the field emission cold cathode, therefore, the number of emitter blocks should be minimum. However, the small number of emitter blocks involves a large area of the emitter block and accordingly, a large defective area caused by one defective emitter, thereby involving a trade-off between the small occupied area and a small defective area caused by one defective emitter.

Moreover, in the second conventional example, a sufficient high serial resistance is not obtained by the resistance layer section 53 because the resistance layer section 53 functions as a two-dimensional resistor, and even if a relatively high resistance is achieved after fabrication thereof, the resistance cannot be maintained after application of an excessive high voltage because of the small effective length of the resistance layer section 53. After all, substantially only the teeth of the resistance layer function as effective resistance portions.

On the other hand, in the first conventional example, since the resistance layer is formed as a part of the conical emitter, the resistance layer functions as the resistor in the thickness direction of the resistance layer. In this configuration, the thickness of the resistance layer is on the order of several tenths of micron at most since the emitter itself has a height of several microns. When a voltage on the order of 100 volts is applied between the gate electrode and an emitter, an electric field as high as $10^5$ volts/cm is applied in the resistance layer. The resistance layer reduces the resistance thereof due to the avalanche effect in this electric field range so that the resistance of the resistance layer is not stable in this range. An additional resistance layer, even if provided as an underlying layer for the conical resistance layer, does not effectively increase the serial resistance for the emitter because of the larger horizontal area of the additional resistance layer.

SUMMARY OF THE INVENTION

In view of the foregoing, it is an object of the present invention to provide a field emission cold cathode having a small occupied area, high operational speed, lower power consumption and high integration density by providing a serial resistance layer of a small horizontal size to the emitter in the field emission cold cathode.

The present invention provides, in a first aspect thereof, a field emission cold cathode comprising a substrate, a resistance layer overlying said substrate and electrically connected to a cathode electrode, said resistance layer being electrically separated into a plurality of resistance layer sections by a separating layer, a plurality of emitters each disposed on a corresponding one of said resistance sections, and a gate electrode having an opening for each of said emitters.

The present invention provides, in a second aspect thereof, a method for manufacturing a field emission cold cathode comprising the steps of forming a resistance layer overlying a substrate, selectively etching at least the resistance layer to form a separating layer for separating the resistance layer into a plurality of resistance layer sections, forming at least one emitter on each resistance layer section, forming a gate electrode layer having an opening for each emitter, and forming a cathode layer connected to the resistance layer.

In a first preferred embodiment of the method according to the present invention, the method comprises the steps of forming a resistance layer overlying a substrate, selectively etching said resistance layer to form a plurality of protrusions on the surface of said resistance layer, selectively etching said resistance layer to form a trench for separating said plurality of protrusions from each other, thermally oxidizing the surface of said resistance layer to form an emitter from each of said protrusions and to fill at least a part of said trench, forming a gate electrode layer having an opening for each said emitter, and forming a cathode layer connected to said resistance layer.

In a second preferred embodiment of the method according to the present invention, the method comprises the steps of forming a resistance layer of a first conductivity type overlying a substrate, selectively etching said resistance layer to form a plurality of protrusions on the surface of said resistance layer, selectively etching said resistance layer to form a trench for separating said plurality of protrusions from each other, depositing a conductive layer of a second conductivity type at least in said trench, forming a gate electrode layer having an opening for each said emitter, and forming a cathode layer connected to said resistance layer.

In a third preferred embodiment of the method according to the present invention, the method comprises the steps of forming a resistance layer overlying a substrate, selectively etching said resistance layer to formal plurality of emitters having a substantially vertical edge on the surface of said resistance layer, thermally oxidizing the surface of said resistance layer to form an oxide film having a smaller thickness region in the vicinity of said vertical edge having a thickness smaller than the thickness of other region of said oxide film, etching-back said oxide film to expose a portion of said resistance layer at said smaller thickness region of said oxide film, etching said exposed portion of said resistance layer to form a trench, depositing a filling in said trench for electrically separating said plurality of emitters from each other, forming a gate electrode layer having an opening for each said emitter, and forming a cathode layer connected to said resistance layer.

In accordance with the present invention, an advantage of a stable resistance having an excellent linearity with an applied voltage is obtained up to approximately 100 volts, thereby preventing the emitter and gate from deformation which might occur due to a large current caused by an unstable resistance. If the trench for separation of the resistance layer has a thickness of 10 $\mu$m and the resistance of the resistance layer section is 100 k$\Omega$, for example, the emitter current can be maintained within 1 mA which does not cause substantially any breakdown of the emitter under the applied voltage below 100 volts.

The present invention also provides an advantage of finer pattern for the resistance layer section. This advantage leads to reduction of parasitic capacitance and parasitic resistance to obtain a high operational speed of the field emission cold cathode.

The present invention also provides an advantage of simplification of the fabrication process. If the emitter and resistance layer are made of silicon, the tip of the silicon emitter can be sharpened simultaneously with the filling of the trench with the buried layer.

PREFERRED EMBODIMENTS OF THE INVENTION

Now, the present invention will be more specifically described based on preferred embodiments thereof with reference to the accompanying drawings.

Figure 1A:
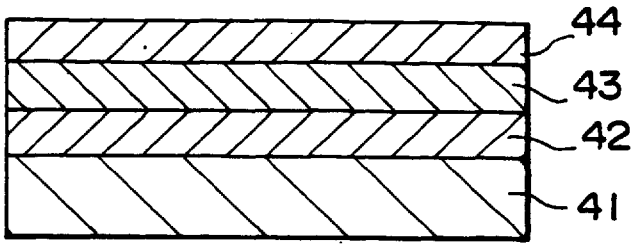
FIG. 1A PRIOR ART
FIGS. 1A to 1F are sectional views of a first example of conventional field emission cold cathodes in consecutive steps of the fabrication process thereof.
Figure 1B:
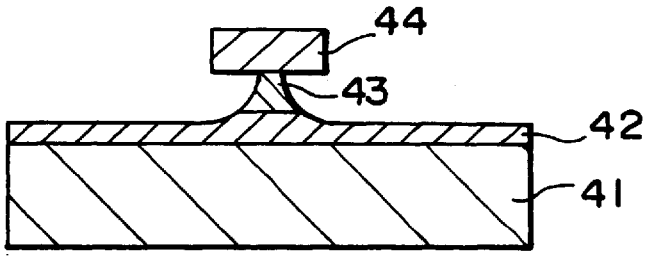
FIG. 1B PRIOR ART
Figure 1C:
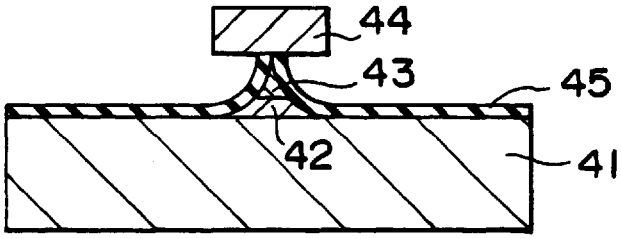
FIG. 1C PRIOR ART
Figure 1D:
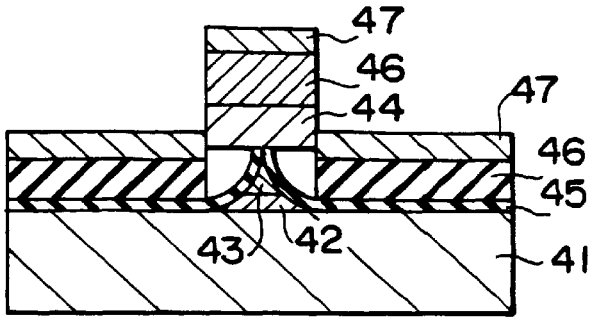
FIG. 1D PRIOR ART
Figure 1E:
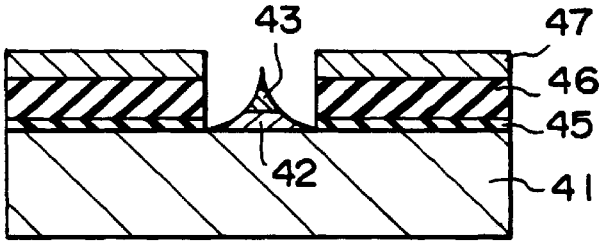
FIG. 1E PRIOR ART
Figure 1F:
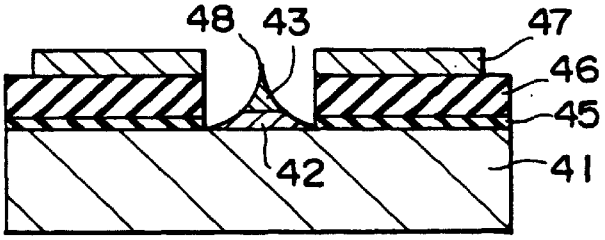
FIG. 1F PRIOR ART
Figure 2:
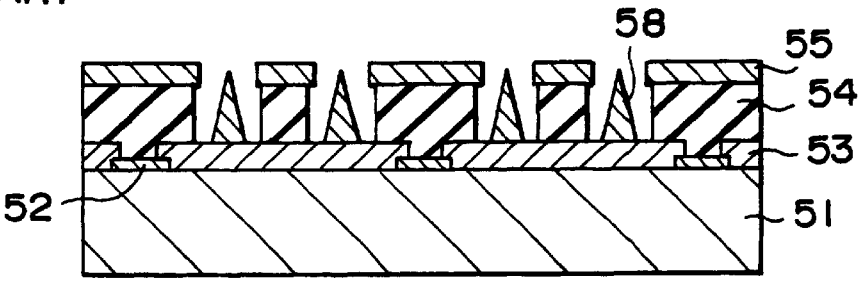
FIG. 2 PRIOR ART
FIG. 2 is a sectional view of a second example of conventional field emission cold cathodes.
Figure 3:
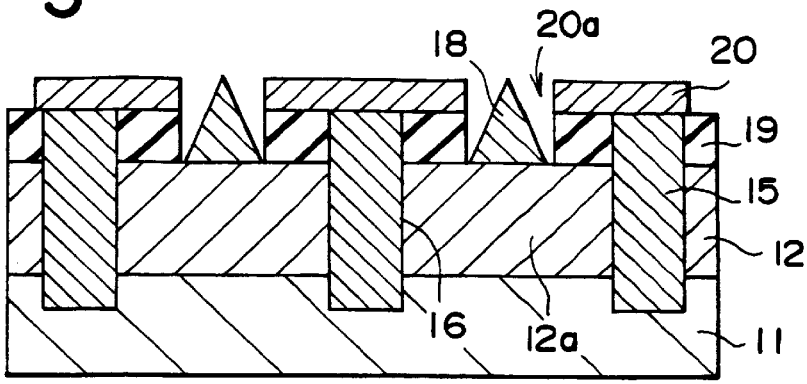
FIG. 3 is a sectional view of a field emission cold cathode according to a typical example of the present invention.

Referring to FIG. 3, the field emission cold cathode according to a typical example of the present invention comprises a silicon substrate 11, a resistance layer 12 grown on the silicon substrate 11 and having a first conductivity. The resistance layer 12 is electrically separated into a plurality of arrayed resistance layer sections 12*a* by a buried layer 15 formed in a deep trench 16 for separation of the resistance layer 12. The buried layer 15 has, in this example, a second conductivity opposite to the first conductivity. The field emission cold cathode further comprises a plurality of conical emitters 18 each formed on a corresponding one of the resistance layer sections 12*a*, an insulator layer 19 having a hole for receiving each conical emitter 18 therein, and a gate electrode layer 20 having an opening 20*a* for each hole and each conical emitter 18.

Figure 4:
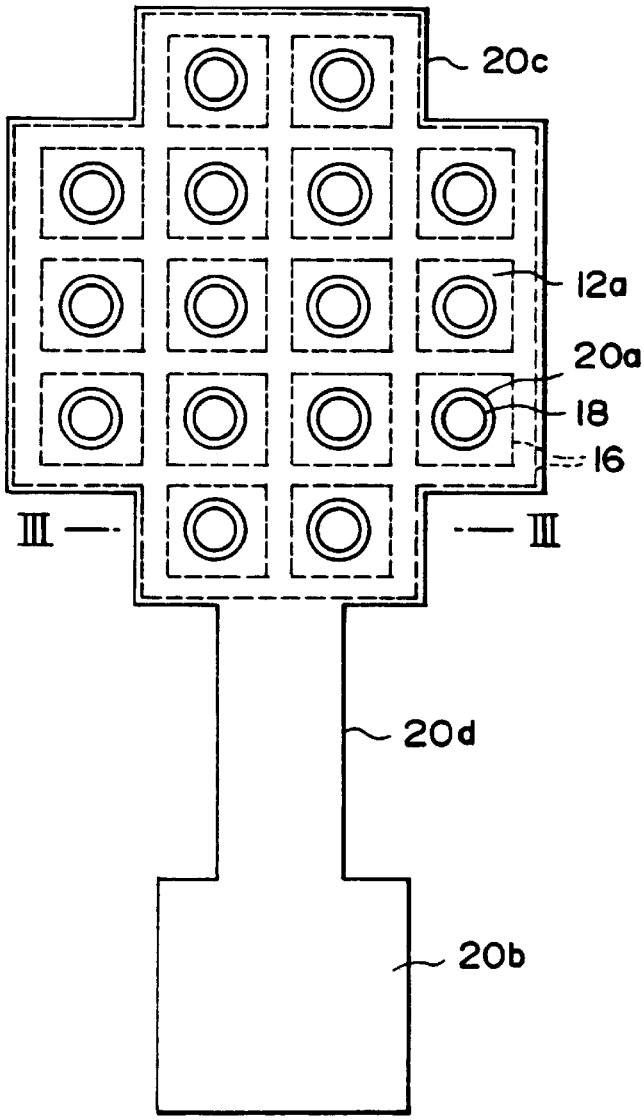
FIG. 4 is a top plan view of the field emission cold cathode of FIG. 3.

FIG. 4 shows a top plan view of a group of emitters in the field emission cold cathode of FIG. 3. FIG. 3 is a cross-sectional view taken along line III—III in FIG. 4. The conical emitters 18 are arrayed in a matrix to form a single emitter group operating as a single pixel. The gate electrode layer 20 comprises a pad 20*b* connected to a signal line not shown, emitter array section 20*c* disposed for the group of emitters 18, and a lead-in portion 20*d* connecting the pad 20*b* and the emitter array section 20*c* together. The emitter array section 20*c* has an array of openings 20*a* for each conical emitter 18. In a preferred configuration, each resistance layer section 12*a* is of a plug shape having a square cross-section wherein the side of the square is significantly small as compared to the length or thickness of the plug.

In the field emission cold cathode of FIGS. 3 and 4, as described above, the resistance layer section 12*a* is inserted between the overlying conical emitter 18 and the underlying substrate 11 connected to a cathode electrode not shown, and electrically separated from other resistance layer sections 12*a* by the buried layer 15 formed in the trench 16. Accordingly, current for each emitter 18 is limited to flow through a single resistance layer section 12*a*. The resistance layer 12 can be formed as a thick layer to provide a sufficient large resistance to the resistance layer section 12*a*. Further, the horizontal area of the resistance layer section 12*a* can be formed small to reduce the occupied emitter area wherein each of the emitters is disposed. The emitter area is free from the spread of the emitter current which occurs in the conventional field emission cold cathode. Accordingly, a smaller occupied area can be obtained and maintained for the field emission cold cathode.

The configuration of the resistance layer section 12*a* maintains a uniform electric field in the resistance layer section 12*a*. Accordingly, the electric field applied to the resistance layer section 12*a* can be controlled to a desired value by selecting the thickness of the resistance layer even when a high voltage is applied across both the ends of the resistance layer sections 12*a*. The control of the electric field allows prevention of short-circuit failure between the gate and emitter due to the discharge and subsequent reduction of the resistance. As a result, a reliable field emission cold cathode can be achieved by this configuration.

Figure 5:
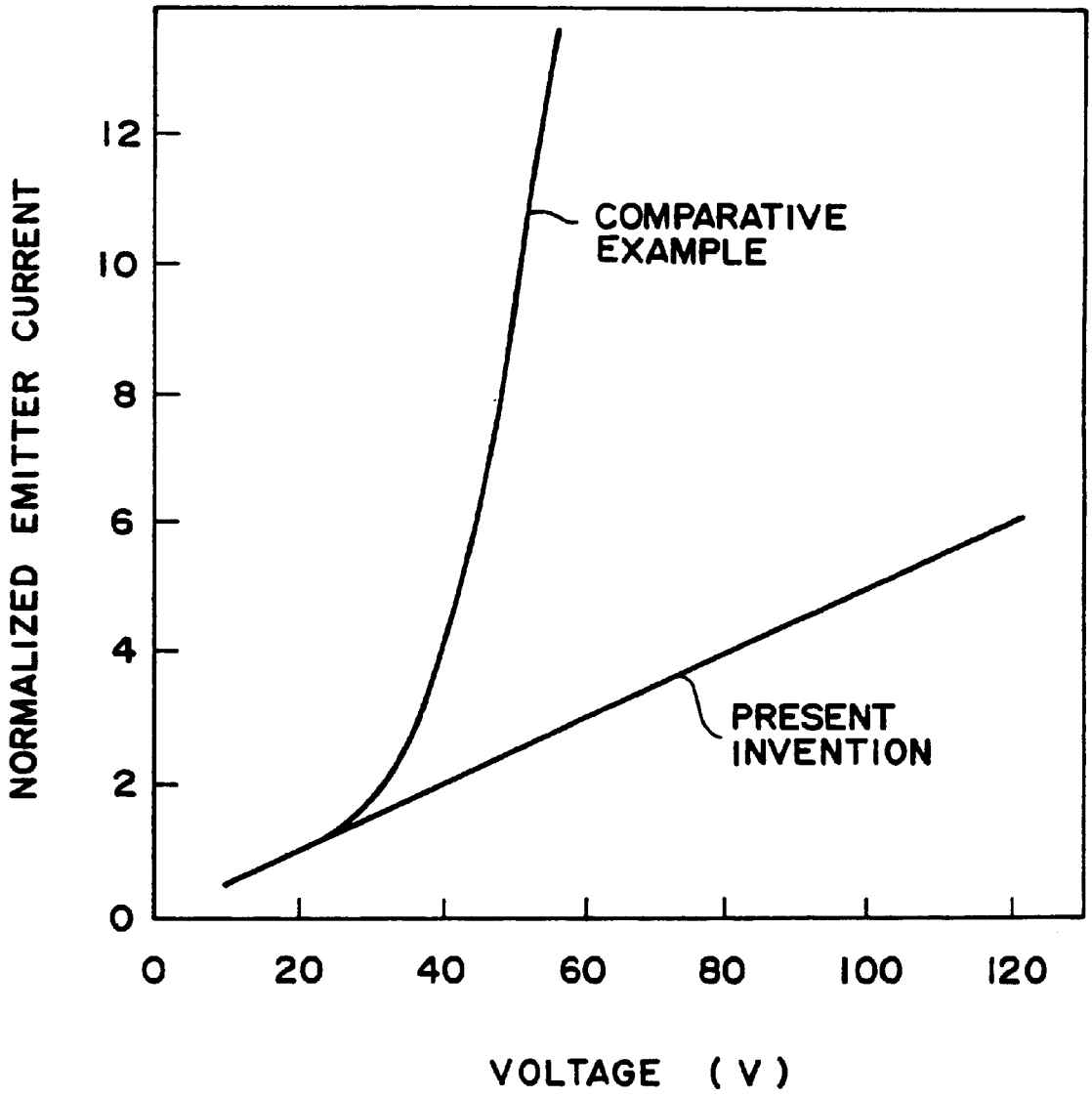
FIG. 5 shows voltage-current characteristics of field emission cold cathodes of the typical example of the present invention and a comparative example.

FIG. 5 shows voltage-current characteristics of the field emission cold cathodes of the typical example of FIG. 3 and of a comparative example, the voltage being applied between the substrate and the emitter. The scale for the emitter current was normalized by the current when the applied voltage was 20 volts which current is scaled as a unit. The configuration of the comparative example was similar to that of the typical example except that the buried layer and trench were not provided in the comparative example. As understood from the graph, the field emission cold cathode of the present invention exhibited an excellent linear relationship between the applied voltage and emitter current in the range of the applied voltage below about 100 volts, whereas the comparative example exhibited a larger current deviated from the linear relationship between the voltage and emitter current at around 30 volts of the applied voltage. From the non-linear curve in the comparative example, it can be considered that the resistance layer, if provided with no separation buried layer, could function as an effective high resistance layer only in the thickness range of 1 $\mu$m thereof due to the horizontal spread of the emitter current in the resistance layer.

In view of the above, the configuration of the resistance layer in the present invention provides a linear characteristic between the applied voltage and emitter current due to the buried layer electrically separating the resistance layer to limit the horizontal spread of the emitter current.

The buried layer having the second conductivity for separation of the resistance layer has an etching rate similar to the etching rate of the resistance layer. This configuration of the buried layer allows a substantially planar structure of the field emission cold cathode due to a substantially equal etching rate of the resistance layer and buried layer. Alternatively, if the emitter and resistance layer are made of a semiconductor material, e.g., Si, the trench may be filled with a thermal oxide layer instead of the second conductive layer simultaneously with the formation of the pointed tip of the conical emitter to reduce the number of fabrication steps.

A specified configuration of the buried insulator layer defining each emitter area, as will be described later, allows an omission of a photolithographic step for formation of the trench or allows formation of trench by a self-alignment technique substantially without margin to reduce an occupied emitter area for the field emission cold cathode.

Figure 6A:
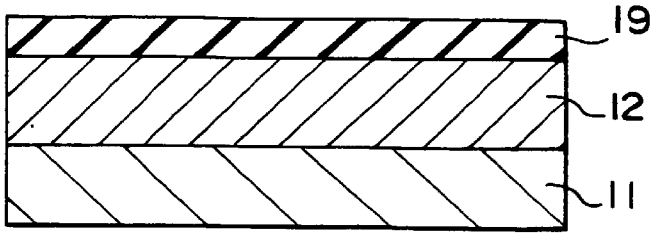
FIGS. 6A to 6H are sectional views of a field emission cold cathode according to a first embodiment of the present invention in consecutive steps of the fabrication process thereof.

FIGS. 6A to 6H consecutively show a process for manufacturing a field emission cold cathode according to a first embodiment of the present invention. In FIG. 6A, an n-type silicon substrate 11 has an impurity concentration of above $10^{15}$ $cm^{-3}$. A 5 $\mu$m-thick N-type resistance layer 12 having an impurity concentration of approximately $10^{14}$ $cm^{-3}$ is formed by an epitaxial process on the silicon substrate 11, followed by a thermal oxidation or CVD process to form a 500 nm-thick oxide insulator film 19 on the resistance layer 12, as shown in FIG. 6A.

Figure 6B:
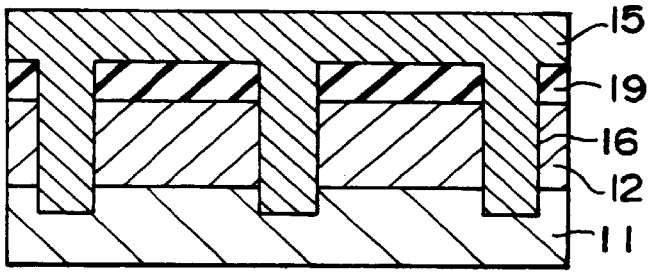

Subsequently, the oxide film 19 is patterned by an anisotropic etching step using a photoresist mask. After removing the photoresist mask, anisotropic etching is effected to the resistance layer 12 and the silicon substrate 11 to form a trench 16 having a width of, for example, 0.4 to 2 $\mu$m. Thereafter, an insulator film 15 having a re-flow property, such as borophospho-silicate glass (BPSG) film, is deposited on the entire surface including the trench 16 by a low pressure chemical vapor deposition (LPCVD) process to a thickness larger than the width of the trench 16. The insulator film 15 is then thermally treated for re-flow at a temperature of 1000° C. to form a planar surface of the BPSG film 15, as shown in FIG. 6B. The side wall of the trench 16 may be preferably thermally oxidized before deposition of the BPSG film 15 to form an oxide film on the silicon surface for suppression of diffusion of impurity atoms from the BPSG film 15 to the silicon substrate 11.

Figure 6C:
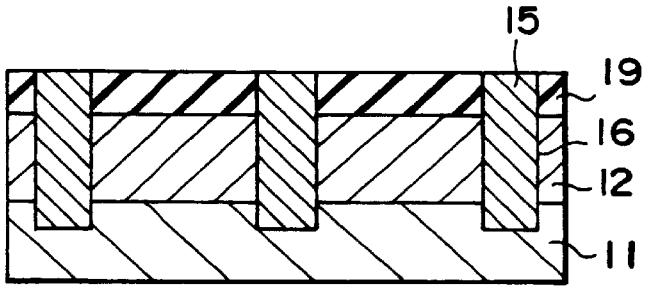
Figure 6D:
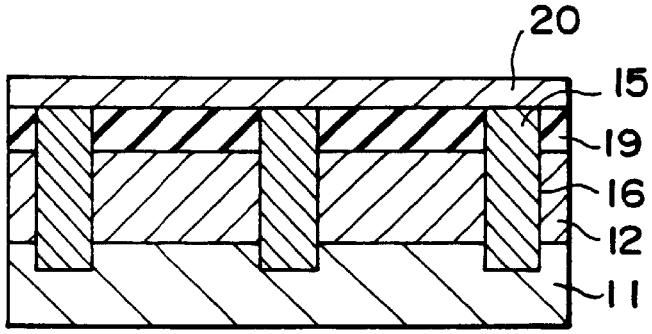
Figure 6E:
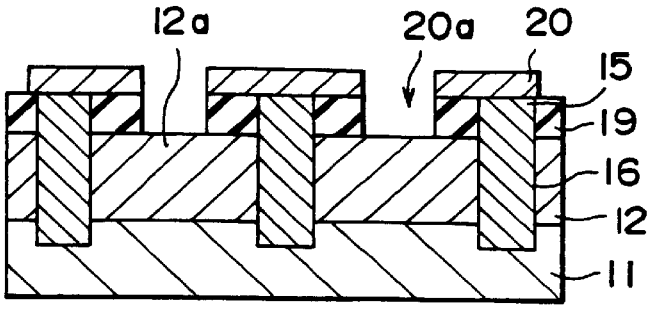

The buried film 15 and underlying insulator film 19 are then etched-back by a plasma-enhanced CVD (PECVD) step using $CHF_3$ gas, for example, to leave a planar surface of the insulator film 19 and buried film 15 which is 400 nm above the bottom of the insulator film 19, as shown in FIG. 6C. Thereafter, a gate electrode film 20 is deposited thereon by sputtering of a metal such as W or Mo to a thickness of 200 nm, as shown in FIG. 6D. The gate oxide film 20 is then patterned by a selective etching technique using $SF_6$ gas and a photoresist mask to form pad 20*b*, emitter array portion 20*c* and lead-in portion 20*d* such as shown in FIG. 4.

Thereafter, an array of openings 20*a* are formed in the emitter array region by consecutively etching the gate electrode film 20 in a $SF_6$ gas ambience and insulator film 19 in a $CHF_3$ ambience to thereby expose the surface of the resistance layer section 12*a* in each opening 20*a* thus formed.

Figure 6F:
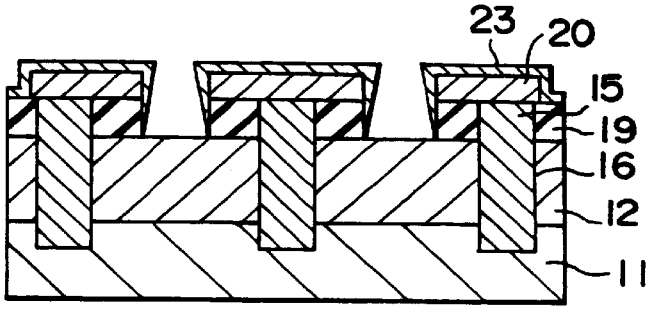
Figure 6G:
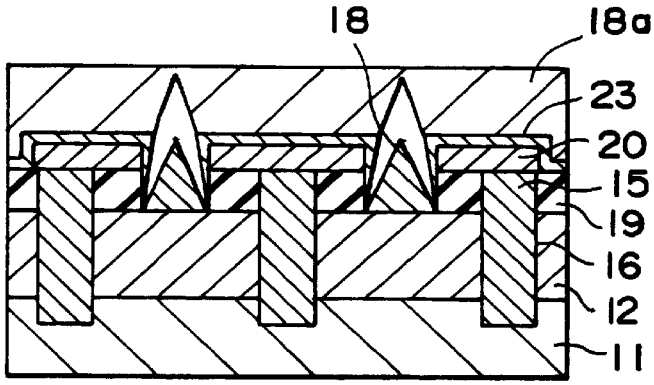
Figure 6H:
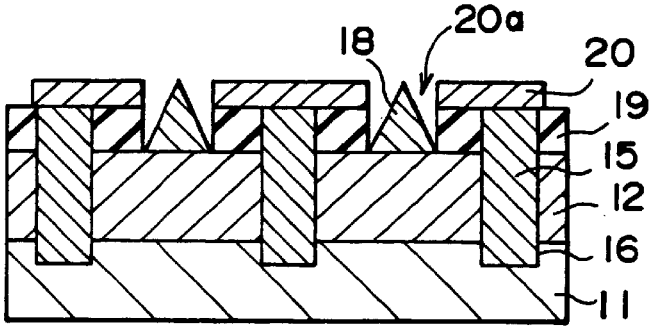

A sacrificial layer 23 of AL is then sputter-deposited in the direction slightly deviated from the vertical direction by an electron-beam evaporation technique to a thickness of 100 nm. In this step, the sacrificial layer 23 is formed on the entire exposed surface except for the surface of the resistance layer section 12*a* in the emitter opening, i.e., on the top and side surfaces of the gate electrode film 20 and side surface of the insulator film 19, as shown in FIG. 6F. Subsequently, an emitter layer 18*a* is deposited on the entire surface by electron-beam evaporation of, for example, Mo in the vertical direction. In this step,the emitter layer 18*a* is deposited on the sacrificial layer 23 and resistance layer 12, and the emitter layer 18*a* on the resistance layer 12 is formed as a conical emitter 18 The emitter layer 18*a* formed on the sacrificial layer 23 is then removed by a subsequent lift-off step in which the sacrificial layer 23 is etched in a phosphoric acid solution, leaving emitter 18 only in each opening. Thus, a field emission cold cathode is obtained, as shown in FIG. 6H.

In the field emission cold cathode fabricated as described above, since each resistance layer section 12*a* for the emitter 18 is surrounded by the separation trench 16 filled with the buried insulator film 15, emitter current flowing in the resistance layer section 12*a* does not spread horizontally more than the designed width. Moreover, a desired serial resistance for the emitter 18 is obtained based on the dimension in the depthwise direction of the resistance layer section 12*a*, and accordingly, the resistance layer section 12*a* does not necessarily require a large occupied area. As a result, an emitter array each having a desired serial resistance can be formed in a smaller occupied area.

The BPSG film 15 filled in the trench 16 is described only for an example, and the BPSG film 15 may be replaced by an undoped oxide film deposited by a LPCVD process or a thermal oxide film. Alternatively, a thermal oxide film may be formed on the side surface of the trench, followed by deposition of a polycrystalline silicon within the wrench and a subsequent oxidation of the surface of the deposited polycrystalline silicon.

Although the bottom of the trench 16 extends in the silicon substrate 11 in the above embodiment, the bottom of the trench 16 maybe above the surface of the silicon substrate 11 so long as the electric field applied in the resistance layer section 12*a* is maintained within an allowable range. The resistance layer 12 may be formed as a diffused layer in the silicon substrate 11 instead of the epitaxially grown resistance layer. It is preferable that the thickness of the resistance layer 12 is relatively larger than the width of the resistance layer section 12*a* because the control of the resistance is relatively easy in this case substantially without the horizontal spread of the emitter current within each resistance layer section 12*a*. The thickness of the resistance layer 12 may be preferably determined such that a maximum electric field is restricted below 10 volts/$\mu$m which does not cause an avalanche phenomenon. These configurations as described heretofore apply not only the first embodiment, but also the following embodiments.

Figure 7A:
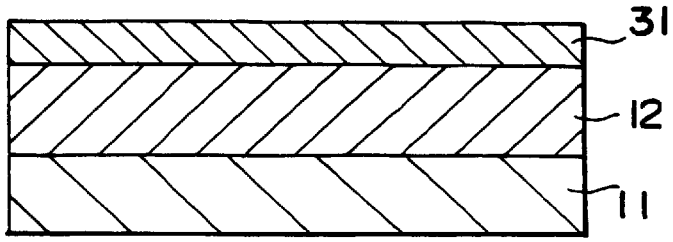
FIGS. 7A to 7G are sectional views of a field emission cold cathode according to a second embodiment of the present invention in consecutive steps of the fabrication process thereof.
Figure 7B:
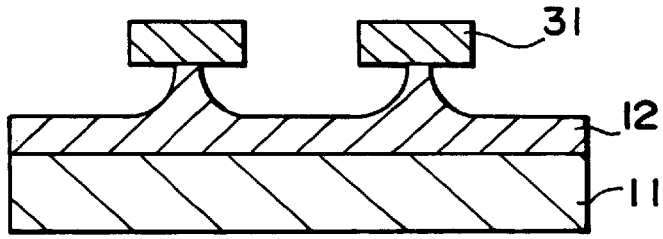

FIGS. 7A to 7G consecutively show a fabrication process of a second embodiment of the present invention, similarly to FIGS. 6A to 6H. In FIG. 7A, an N-type silicon substrate 11 has an impurity concentration of above approximately $10^{15}$ $cm^{-3}$. A 5 $\mu$m-thick N-type resistance layer 12 having an impurity concentration of approximately $10^{14}$ $cm^{-3}$ is formed by an epitaxial process on the silicon substrate 11, followed by a thermal oxidation or CVD process to form a 200 nm-thick mask film 31 on the resistance layer 12.

Subsequently, the mask film 31 is etched by an anisotropic etching step using $CHF_3$gas etc. and a photoresist mask at the region other than each emitter area to form a mask pattern 31, followed by isotropic etching of the exposed resistance layer 12 by using $SF_6$ gas and the mask pattern 31 to form a protrusion in each emitter area. The width of the top portion of the resistance layer section 12*a* is approximately 200 nm, and the depth of the etching in the resistance layer 12 is approximately 700 nm.

Figure 7C:
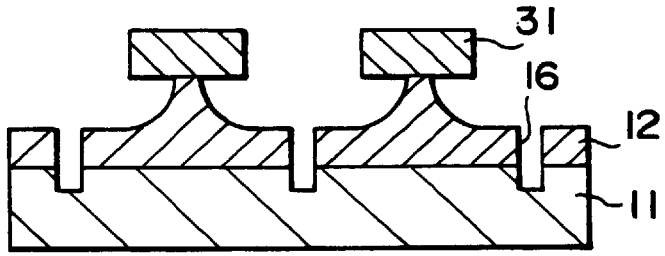
Figure 7D:
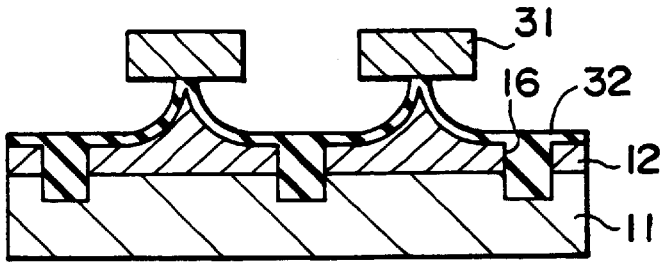

Thereafter, consecutive anisotropic etching of the resistance layer 12 and then exposed silicon substrate 11 is effected in the vertical direction to form a trench 16 having a width of 0.4 $\mu$m, as shown in FIG. 7C. Subsequently, a thermal oxidation is effected to the resistance layer 12 and exposed silicon substrate 11 to form a thermal oxide layer 32 having a thickness of approximately 400 nm, as shown in FIG. 7D.

Figure 7E:
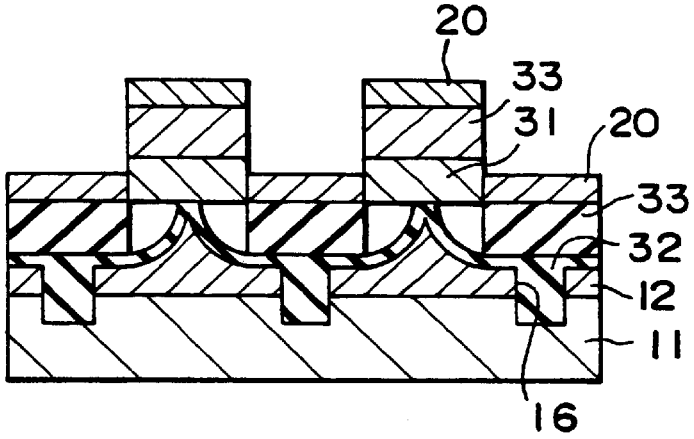
Figure 7F:
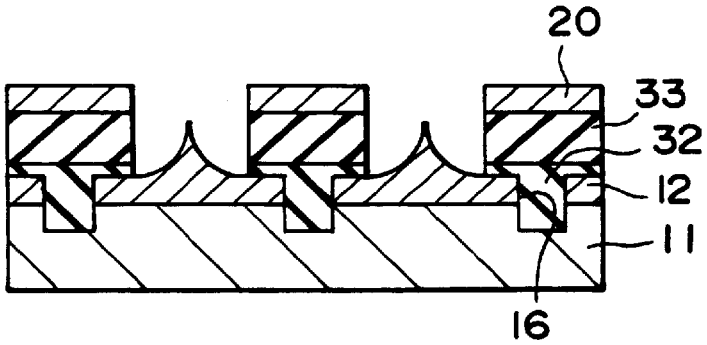

Thereafter, an oxide film 33 is deposited in the vertical direction by an electron-beam evaporation technique to a thickness of approximately 200 nm, followed by deposition of a gate electrode film 20 made of Mo to a thickness of approximately 200 nm, as shown in FIG. 7E. Then, the mask pattern 31 and the thermal oxide film 32 are removed frog the emitter area by an etching step using a hydrofluoric acid. In this step, the deposited oxide film 33 and the gate oxide film 20 on the mask pattern 31 are also removed by lift-off to expose the conical protrusion of the resistance layer 12, as shown in FIG. 7F.

Figure 7G:
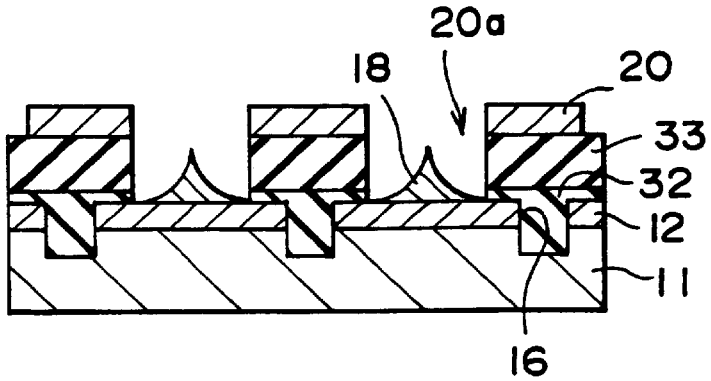

The gate electrode film 20 is then patterned by using a photoresist mask and $SF_6$ gas to form a gate electrode 20, followed by ion-implantation into the conical protrusion of the resistance layer 12 or selectively coating of the conical protrusion to form a low-resistance conical emitter 18. Thus a field emission cold cathode is achieved, as shown in FIG. 7G.

In the second embodiment, since silicon layer 12 is used for the conical emitter 18 instead of the metallic emitter, the trench 16 can be filled with the thermal oxide film 32 simultaneously with sharpening of the conical protrusion to reduce the number of fabrication steps. Alternatively, the trench 16 may be filled with a CVD film. In the second embodiment, similar advantages such as a stable resistance can be obtained as described in the first embodiment.

Figure 8A:
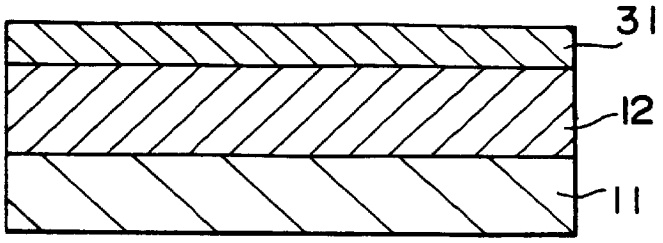
FIGS. 8A to 8H are sectional views of a field emission cold cathode according to a third embodiment of the present invention in consecutive steps of the fabrication process thereof.
Figure 8B:
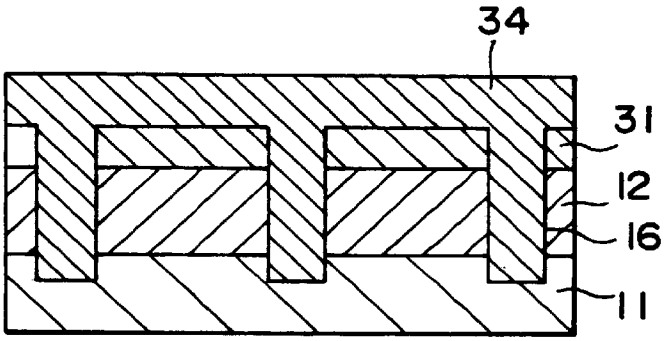

FIGS. 8A to 8H consecutively show a method for fabricating a field emission cold cathode according to a third embodiment of the present invention. In FIG. 8A, an N-type silicon substrate has an impurity concentration of $10^{15}$ $cm^{-3}$ A 5 $\mu$m-thick N-type resistance layer 12 having an impurity concentration of $10^{14}$ $cm^{-3}$ is formed by an epitaxial process on the silicon substrate 11, followed by a thermal oxidation or CVD process to form a 200 nm-thick oxide film 31, as shown in FIG. 8B.

Figure 8C:
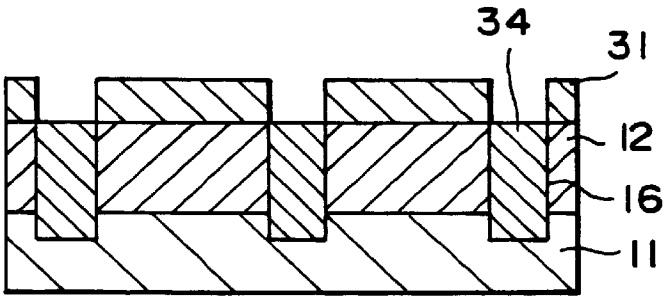

Subsequently, the oxide film 31 is patterned by an anisotropic etching step using a photoresist mask to form an opening for the resistance layer 12 at a region where the trench is to be formed. After removing the photoresist mask, anisotropic etching step is effected to the resistance layer 12 and the silicon substrate 11 to form a trench 16 having a width of, for example, 0.4 to 2 $\mu$m. Thereafter, a P-type polycrystalline silicon film 34 doped with boron is deposited on the entire surface including the trench 16 by a LPCVD process to a thickness of 2 $\mu$m, as shown in FIG. 8C. The conductive polycrystalline film 34 is then etched back to a thickness so that the mask film 31 is exposed and then the top surface of the resistance layer 12 is flush with the top of the trench 16, as shown in FIG. 8C.

Figure 8D:
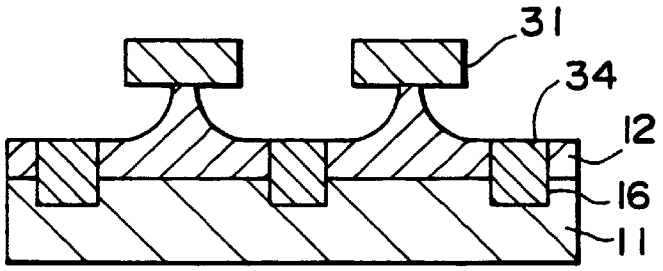

The mask film 31 is then selectively removed by anisotropic etching step using a photoresist mask and $CHF_3$ gas in the region other than the emitter area. An isotropic etching step using the mask film 31 and $SF_6$ is effected to the exposed resistance layer 12 and conductive film 34 to form a protrusion in the resistance layer 12 and to make the conductive film 34 and the resistance layer 12 in the vicinity of the trench 16 flush with the top of the trench 16, as shown in FIG. 8D. The width of the protrusion in the resistance layer 12 is approximately 100 nm and the depth of the etching of the resistance layer 12 and the conductive film 34 is approximately 700 nm.

Figure 8E:
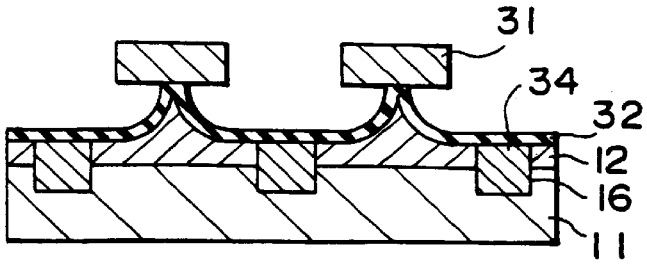
Figure 8F:
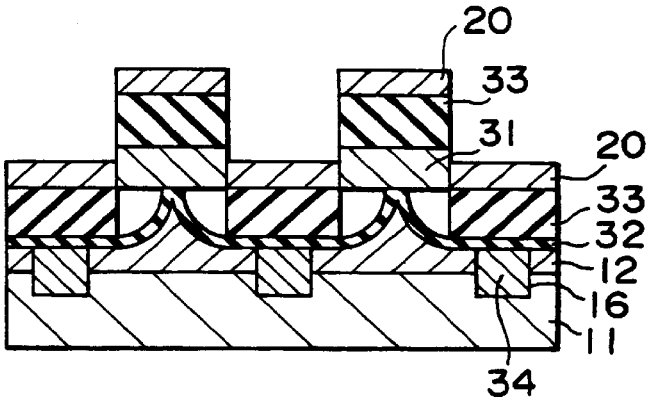

A thermal oxidation is then effected to the resistance layer 12 and the conductive layer 34 to form a 100 nm-thick oxide film 32, as shown in FIG. 8E, wherein the tip of the protrusion in the resistance layer 12 is sharpened.

Figure 8G:
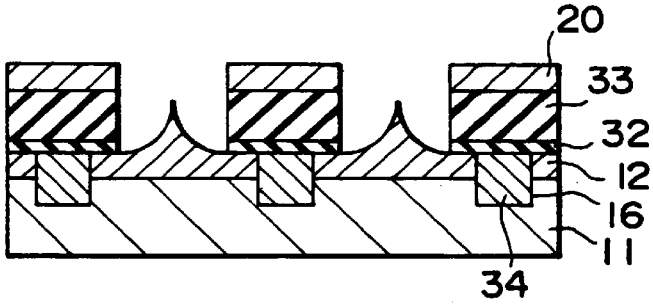

Subsequently, a 400 nm-thick insulator film 33 and a gate electrode film 20 made of Mo or W are consecutively deposited by an electron-beam evaporation technique in the vertical direction on the entire surface. Then, the oxide mask film 31 and insulator film 32 on the protrusion of the resistance layer 12 are removed by etching using hydrofluoric acid. In this step, the insulator film 33 and gate electrode film 20 on the mask film 31 are also removed and the protrusion of the resistance layer 12 is exposed, as shown in FIG. 8G.

Figure 8H:
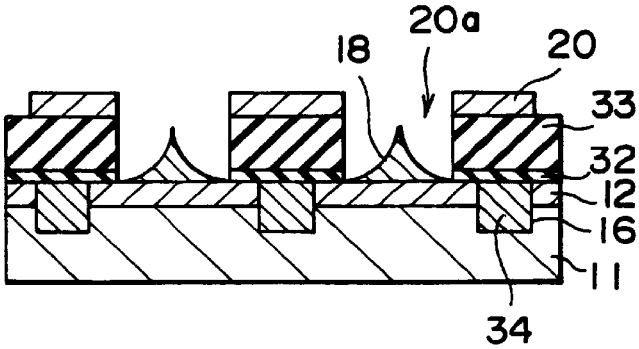

Subsequently, the gate electrode film 20 is patterned using a photoresist mask and $SF_6$ gas, followed by an ion-implantation effected to the resistance layer 12 to reduce the resistance of the protrusion to form an emitter, thereby achieving a field emission cold cathode according to the third embodiment of the present invention shown in FIG. 8H. The reduction of the resistance of the protrusion may be effected by selective coating by a metallic film.

In the third embodiment, the polycrystalline silicon film 34 as used for filling the trench 16 provides an equivalent etching rate with the etching rate of the resistance layer 12, thereby obtaining a uniform surface. The polycrystalline silicon film 34 also provides an advantage of effectively filling a wider trench 16 by formation of the opening prior to the formation of the protrusion. Since the P-N junction formed between the P type polycrystalline silicon 34 and the N-type resistance layer 12 defines the resistance layer section 12*a* for each emitter, the width of the resistance layer section 12*a* can be controlled by doping and subsequent thermally diffusion of boron ions into the resistance layer section 12*a* through the polycrystalline film 34 and the P-N junction even after the width of the trench 16 is established.

Figure 9A:
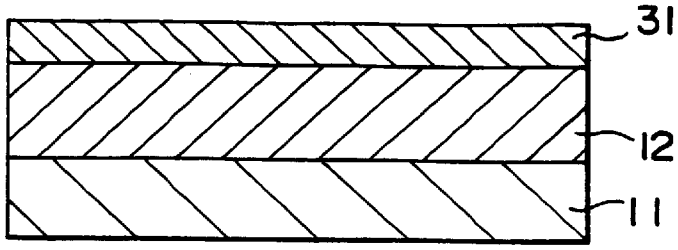
FIGS. 9A to 9H are sectional views of a field emission cold cathode according to a fourth embodiment of the present invention in consecutive steps of the fabrication process thereof.
Figure 9B:
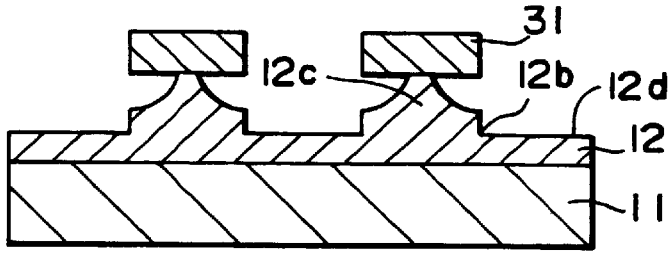
Figure 9C:
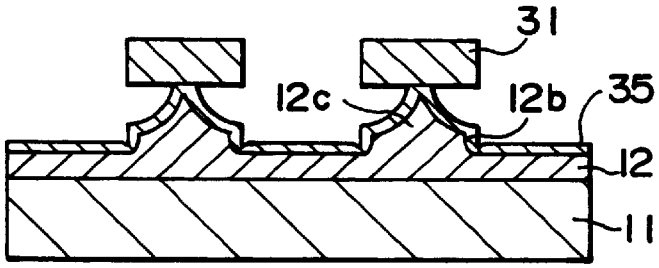

FIGS. 9A to 9H consecutively show a field emission cold cathode according to a fourth embodiment of the present invention. In FIG. 9A, an N-type silicon substrate 11 has an impurity concentration of $10^{15}$ $cm^{-3}$. A 5 $\mu$m-thick N-type silicon resistance layer 12 having an impurity concentration of $10^{14}$ $cm^{-3}$ is formed thereon, followed by forming a mask film 31 by a thermal oxidation or CVD process to a thickness of approximately 200 nm. Then, an anisotropic etching process is effected to the mask film 31 in the area other than the emitter area by using a photoresist mask and $CHF_3$ gas, followed by an isotropic etching of the exposed resistance layer 12 by using the mask film 31 and $SF_6$ gas to form a protrusion 12*c* of the resistance layer 12 in the emitter area. In this step, the resistance layer 12 is etched so that the edge portion 12*b* of the protrusion 12*c* is substantially formed as a vertical plane.

Subsequently, a thermal oxidation is effected to the resistance layer 12 to form a 200 nm-thick thermal oxide film 35, which has a substantially equal thickness in the area other than the region in the vicinity of the vertical, edge portion 12*b* of the protrusion 12*c* where the oxide film 35 has a smaller thickness.

Figure 9D:
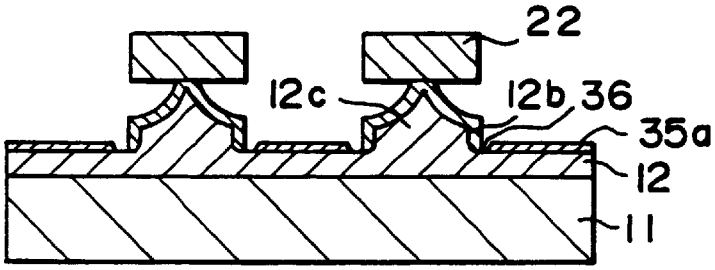

Then, an anisotropic etching is effected to etch the oxide film 35 by approximately 100 nm to thereby entirely remove the small thickness portion of the oxide film 35 and expose the resistance layer 12 in the vicinity 36 of the vertical edge portion 12*b* of the protrusion 12*c*, whereas the oxide film 35 having approximately 100 nm-thickness remain in the other region, as shown in FIG. 9D.

Figure 9E:
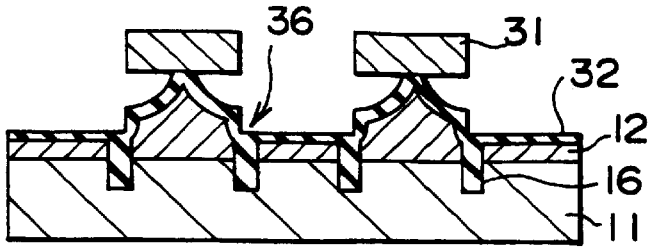
Figure 9F:
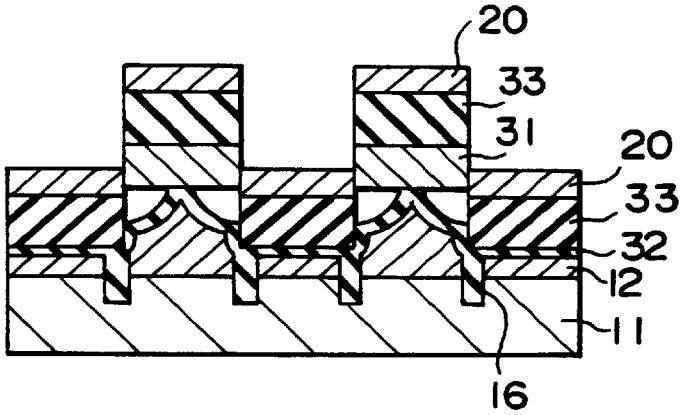

Subsequently, an anisotropic etching step is effected to the exposed resistance layer 12 at the portion 36 and silicon substrate 11 by using the oxide film 35*a* and mask film 31 as a mask to form a vertical trench 16. A thermal oxidation is then effected to form an oxide film in the trench 16 and to increase the thickness of the oxide film 35*a*, thereby obtaining a thick oxide film 32, as shown in FIG. 9E. In this step, the tip of the protrusion is sharpened. An insulator film 33 is then deposited by an electron-beam evaporation process in the vertical direction, followed by deposition of a gate electrode film 20 made of a metal such as Mo or W to a thickness of 100 nm, as shown in FIG. 9F.

Figure 9G:
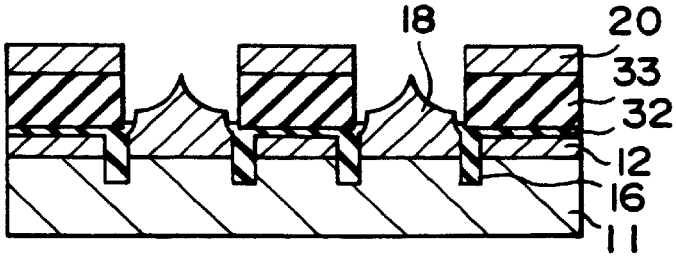
Figure 9H:
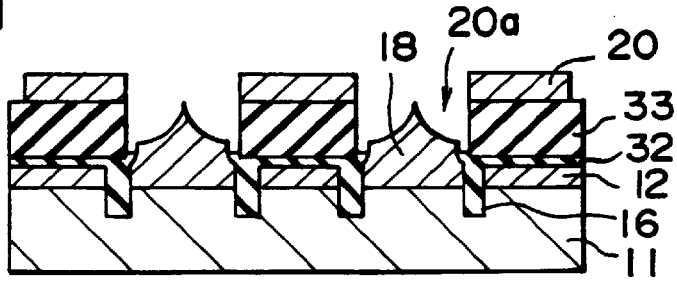

The mask film 31 and the oxide film 32 in the emitter area are then removed by etching using hydrofluoric acid. In this step, the insulator film 33 and the gate electrode film 20 on the mask film 31 are also removed by lift-off, thereby exposing a protrusion 18 of the resistance layer 12, as shown in FIG. 9G. Then, the gate electrode film 20 is patterned using a photoresist mask and $SF_6$ gas to form the field emission cold cathode shown in FIG. 9H. The resistance of the resistance layer 12 is then reduced by ion-implantation or, work function of the emitter is additionally reduced by coating a metallic film thereon.

In the fourth embodiment, the opening for etching the trench 16 can be formed by a self-alignment process so that photolithography for forming the trench 16 can be omitted to thereby simplify the fabrication process. In addition the margin to be formed between the emitter 18 and trench 16 can be reduced by the self-alignment process so that smaller occupied emitter area can be also obtained.

Figure 10:
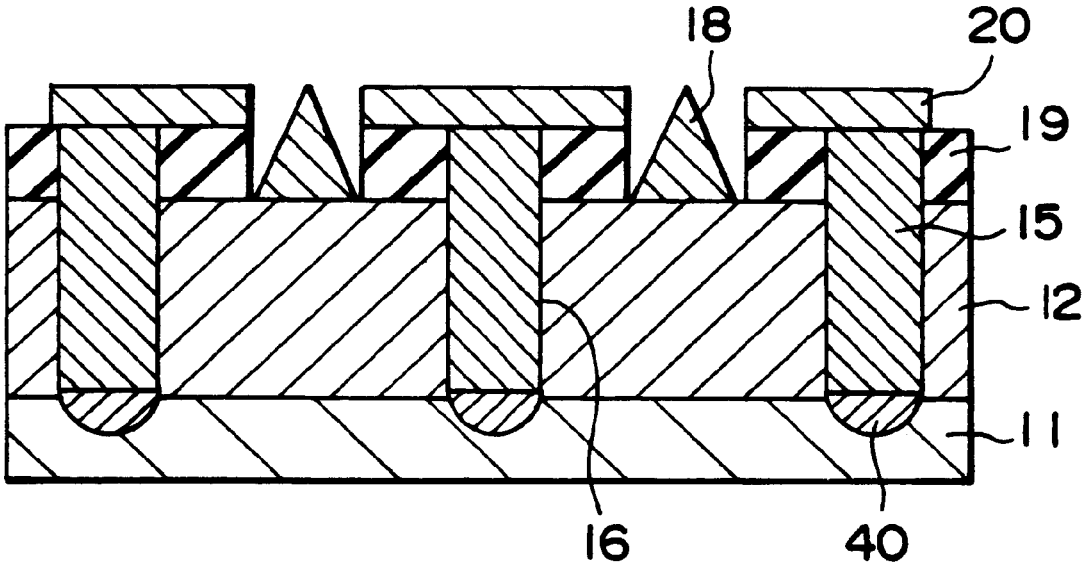
FIG. 10 is a sectional view of a field emission cold cathode according to a fifth embodiment of the present invention.

FIG. 10 shows a field emission cold cathode according to a fifth embodiment of the present invention. The field emission cold cathode of the present embodiment is similar to the first embodiment except for a P-type conductive layer 40 formed on the bottom of the trench 16 in the present embodiment.

In a fabrication process of the present embodiment, an ion-implantation technique using boron ions accelerated at 70 keV is effected to the silicon substrate 11 between the steps of formation of the trench 16 and deposition of the buried film 15 as described in the first embodiment. The remaining steps are similar to the steps of the first embodiment. The ion-implantation of the bottom of the trench 16 as used in the present embodiment may be applied to other embodiments as described before.

In the fifth embodiment, the P-type bottom layer 40 functions for defining the length of the serial resistance layer for each emitter so that the length of the resistance layer section underlying the emitter may be selected to be longer than the depth of the trench 16. In addition, by selecting the width of the P-type bottom layer 40, a desire width of the resistance layer section can be obtained for controlling the serial resistance. In the above embodiment it is exemplarily described that each resistance layer section corresponds to each emitter. However, a plurality of emitters may be disposed on a single resistance layer section, so long as the resistance layer corresponding to a single emitter group is divided into a plurality of resistance layer sections.

Although the present invention is described with reference to preferred embodiments thereof, the present invention is not limited thereto and various modifications or alterations can be easily made therefrom by those skilled in the art without departing from the scope of the present invention.

What is claimed is:

1. A field emission cold cathode comprising a substrate, a resistance layer overlying said substrate and connected to a cathode electrode, a separating layer for electrically separating said resistance layer into a plurality of resistance layer sections, a plurality of emitters each formed on a corresponding one of said resistance layer sections, and a gate electrode having an opening disposed corresponding to each of said emitters, wherein said plurality of resistance layer sections provide series resistance between said cathode electrode and said emitters.

2. A field emission cold cathode as defined in claim 1 wherein said separating layer is made of an insulator.

3. A field emission cold cathode as defined in claim 1 wherein said separating layer is made of semiconductor having a conductivity type opposite to a conductivity type of said resistance layer.

4. A field emission cold cathode as defined in claim 1 further comprising a semiconductor layer disposed at the bottom of said separating layer for additionally separating said resistance layer.

5. A field emission cold cathode as defined in claim 1 wherein said resistance layer section is of a square shape having a horizontal side smaller than the thickness of said resistance layer section.

6. A field emission cold cathode as defined in claim 1 wherein one of said emitters corresponds to one of said resistance sections.

* * * * *